US005518125A

United States Patent [19]

Colosimo

[11] Patent Number: 5,518,125

[45] Date of Patent: May 21, 1996

[54] CD WALL FRAME

[76] Inventor: James A. Colosimo, 23231 Port, St. Clair Shores, Mich. 48082

[21] Appl. No.: 311,113

[22] Filed: Sep. 23, 1994

[51] Int. Cl.[6] ..... A47F 7/00

[52] U.S. Cl. ..... 211/40; 211/88; 40/124

[58] Field of Search ..... 211/40, 41, 87, 211/88, 71; 40/124; 248/309.1

[56] References Cited

U.S. PATENT DOCUMENTS

| | | | |
|---|---|---|---|
| 4,573,749 | 3/1986 | Massaro | 211/40 |
| 4,867,306 | 9/1989 | Factor | 211/40 X |
| 5,040,687 | 8/1991 | Whittington | 211/88 X |
| 5,052,564 | 10/1991 | Zuzack | 211/40 |
| 5,105,952 | 4/1992 | Krattiger | 211/94 X |
| 5,148,925 | 9/1992 | Altoff et al. | 211/94 X |
| 5,172,817 | 12/1992 | Gross | 211/40 |
| 5,341,942 | 8/1994 | James | 211/94 X |
| 5,351,835 | 10/1994 | Hallgren | 211/88 X |
| 5,372,263 | 12/1994 | Niekel | 211/41 |

*Primary Examiner*—Robert W. Gibson, Jr.

[57] ABSTRACT

A CD wall frame for the storage of compact discs (CD's) and the display of compact disc jewel boxes (CDJB's) including interconnected horizontal and vertical beams with protrusions from the horizontal beams for supporting CDJB's standing on edge.

3 Claims, 12 Drawing Sheets

CD WALL FRAME

FIELD OF THE INVENTION

The present invention relates in general to compact disc (CD) storage racks and in particular to a CD wall frame for displaying the front faces of compact disc jewel boxes (CDJB's) on the interior walls of a home.

BACKGROUND OF THE INVENTION

Disadvantages of conventional CD storage racks have been well documented in previous patents including U.S. Pat. Nos. 5,232,089 of Kim, 5,172,817 of Gross, 5,052,564 of Zuzack, 4,951,826 of Tompkins, 4,940,147 of Hunt, and 4,919,287 of Haskett et al. Conventional storage racks store CDJB's in a manner that allows only the title edges to be viewed. Searching through a stack of CDJB edge-titles for a particular CD requires much analytical effort by the owner, a task that is generally unenjoyable. Further, the owner usually performs the edge-title search while uncomfortably hunched or crouched over the conventional storage rack. Ideally, the owner wants to be able to survey the front face cover art of his CD collection while reclined in his favorite chair. In this way, he can make a musical selection based on his emotional response to the casual surveying process.

Additionally, many music fans are kids and young adults who have no budget for fine art to hang on their walls. CDJB cover art provides copies of high quality, expensive artistic expression that deserve to be displayed. Yet, many CD owners have few options except to stack their CDJB's in a conventional rack and leave their walls barren. With CD wall frames, young adults living in small rooms or apartments can happily fill their walls with CD's while also preserving valuable floor space previously consumed by conventional CD storage racks.

The previous patents mentioned herein use a variety of retention devices to retain or confine the CDJB's in their display positions. Hook and loop fasteners, springs, latches, grooves, and kick bars are each employed for retention purposes. Unfortunately, these retention devices add complexity and expense to their respective manufactures, and they increase the time and difficulty experienced when trying to rearrange CDJB's already on display. Both the higher cost and the hassles of reduced accessibility combine to lower the appeal of these storage devices to the consumer.

The present invention has several advantages over the previous patents mentioned herein. The present invention has no back panel, no hook-and-loop fasteners, and no latch mechanisms. These components are eliminated in favor of cost-reduction, minimum material usage, and improved function. Material usage is minimized to reduce weight, the cost of manufacture, and the cost of shipping. To improve function, retention devices are designed out so that the CDJB's may rest securely yet unconstrained on the CD wall frame. This reduced contact between the CDJB's and the CD wall frame improves the CD wall frame's ease-of-use. The owner may now quickly and effortlessly retrieve, replace, and rearrange the CDJB's on the CD wall frame. Further, the CDJB's need not be altered with glued-on fasteners and are not scratched or damaged using the present invention.

There is therefore a need for an esthetically appealing, lightweight, inexpensive CD wall frame that allows the CD owner to display CDJB cover art, allows the owner to choose a CD emotionally from viewing his CDJB cover art, and allows the owner to feel that choosing a CD is a fun experience instead of an eye-straining search through CDJB edge-titles.

It is a principal object of this invention to provide a CD storage rack that allows CDJB cover art to be displayed in full view, allows the owner to locate a CD by viewing its front face cover art, and allows the owner to choose a CD by surveying the cover art of his collection while reclined in his favorite chair.

Additional objects are to provide a CD storage rack that provides economical CD storage, eliminates the use of floor space for CD storage, eliminates the requirement to read CDJB title edges when selecting a CD, eliminates scratches that commonly occur on CDJB's while using other storage methods, eliminates the requirement for a retention device and a back panel, and allows CDJB's to be quickly and effortlessly removed and rearranged without first releasing a latch, fastener, or other retention device.

BRIEF SUMMARY OF THE INVENTION

The foregoing objects can be accomplished by providing a CD wall frame utilizing the inside walls of the home for storing CDJB's. In the preferred embodiment of the invention, four horizontal beams are positioned generally parallel to one another at 5 ½" increments. Each end of each horizontal beam is overlapped front and back by two vertical beams, and the one horizontal and two vertical beams at each area of overlap are joined together by a single ⅝" staple. Since there are eight areas of overlap, eight staple joints are formed in total per CD wall frame. Excluding the top horizontal beam, 16 staple protrusions protrude from the face of each of the horizontal beams. The staple protrusions are composed of 1" staples hammered 3/16" deep into the face of the horizontal beam. The remaining 13/16" protrudes outwardly from the face of the horizontal beam at a 12-degree inclining angle. Assuming that the CD wall frame 10 is hanging generally vertically, the base edge of each CDJB stands on two protrusions spaced 2" apart. When placed vertically on the two protrusions, earth's gravitational effects combined with the 12-degree inclining protrusions ensure that each leans back and contacts at least one of the two horizontal beams behind it. The owner next pushes on the front face of each CDJB using his fingertips until the back face of each CDJB contacts both of the horizontal beams behind it. Each CDJB is now in its display position resting generally vertical on the generally vertically hanging CD wall frame. The 12-degree inclining angle of the protrusions combined with the effects of gravity discourage the CDJB's from falling forward off the CD wall frame 10 even in the presence of external forces. Incidental bumps or knocks to the CD wall frame 10 are insufficient to force CDJB's from their display positions.

DETAILED DESCRIPTION

Figure 1:
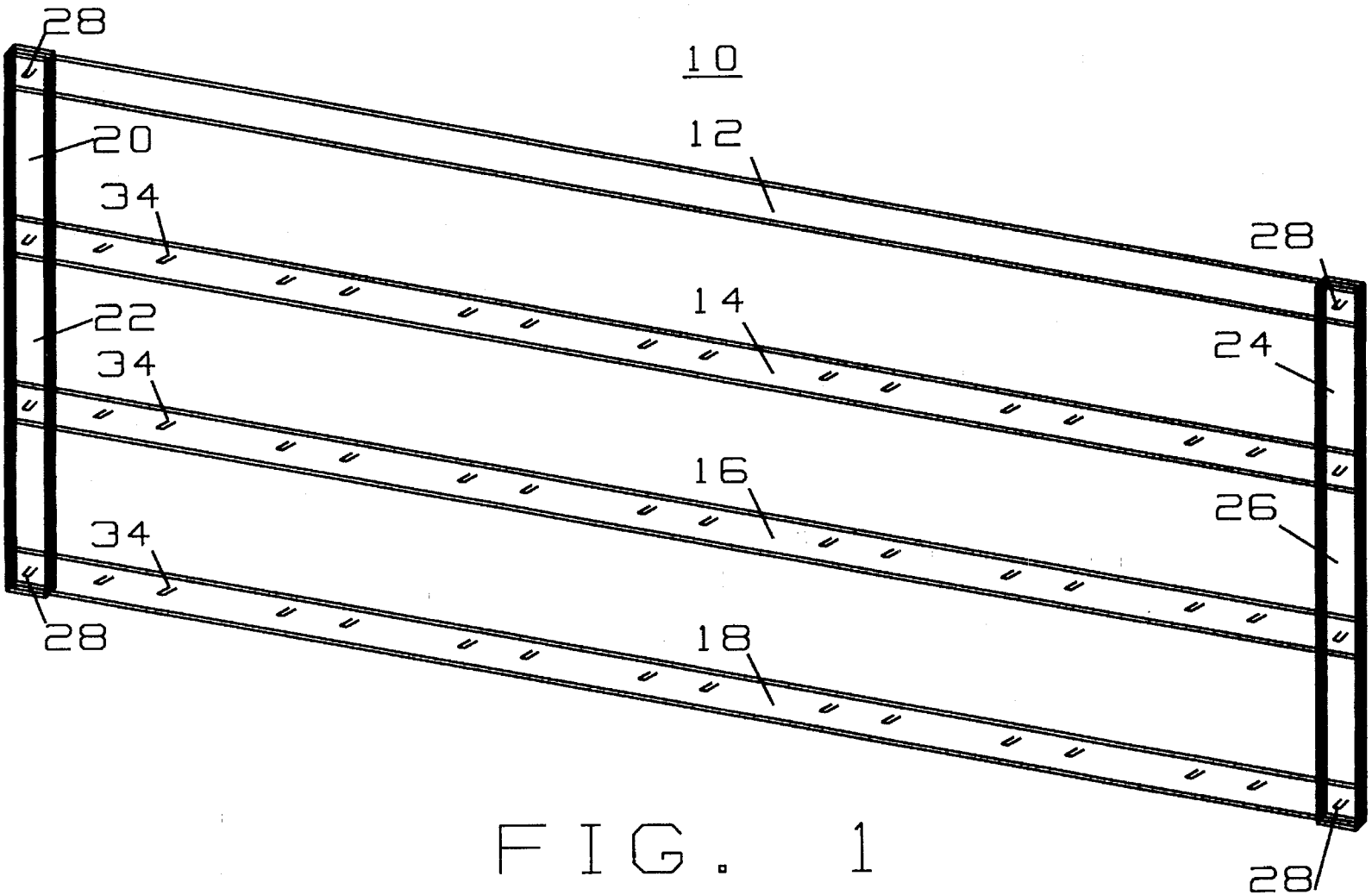
FIG. 1 is a isometric view showing one preferred embodiment of a CD wall frame constructed according to the present invention.
Figure 2:
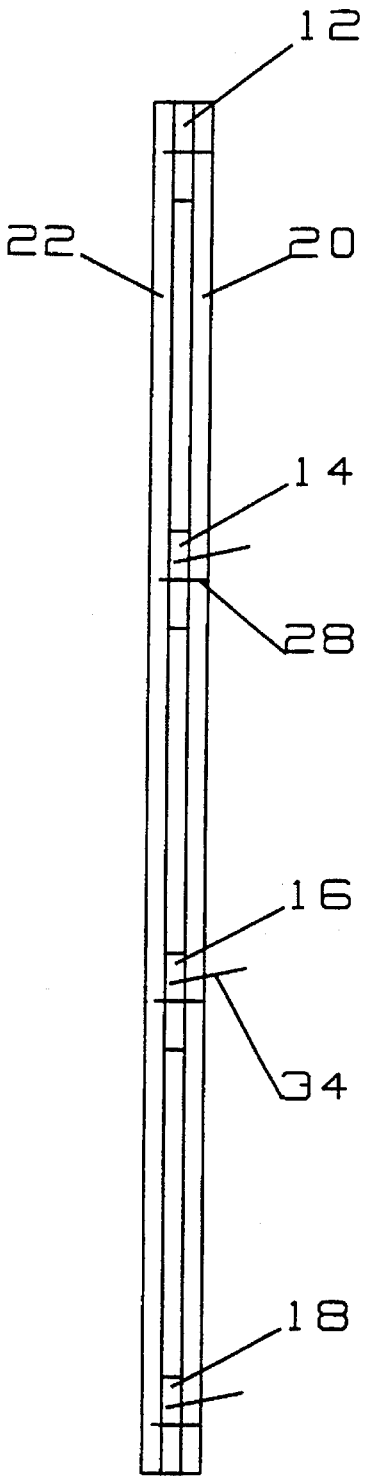
FIG. 2 is a left end view of the present invention.
Figure 3:
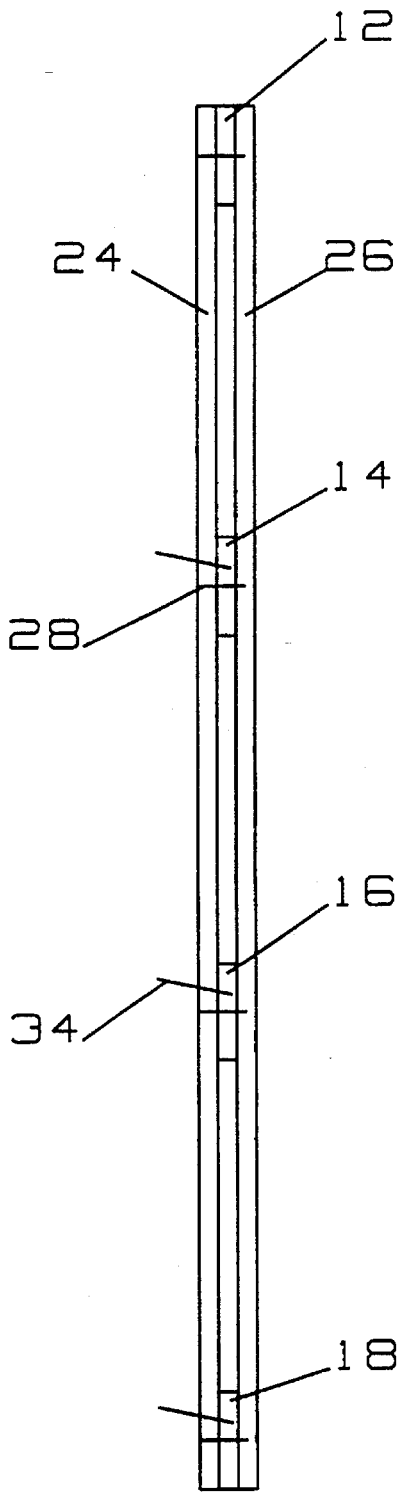
FIG. 3 is a right end view of the present invention.

Referring now to the drawings, FIG. 1 is an overall drawing of a preferred embodiment of the invention. FIG. 1 shows compact disc (CD) wall frame 10 which includes wood beams beam A 12, beam B 14, beam C 16, and beam D 18 positioned generally horizontally in a single plane, generally parallel to one another at 5 ½" increments. The four horizontal beams A,B,C,D 12,14,16,18 each have dimensions 43.0"L×1 ¼" W ×¼ T (Length×Width×Thickness). The CD wall frame 10 also includes four generally vertical beams E,F,G,H 20,22,24,26 with dimensions 17.8" L ×1 ¼" W×¼" T. The ends of beams A–D 12,14,16,18 are overlapped at the left-front by beam E 20, at the left-rear by beam F 22, at the right-front by beam G 24, and at the right-rear by beam H 26. The ends of beams A,B,C,D 12,14,16,18 are effectively sandwiched on the left by beams E,F 20,22 and on the right by beams G,H 24,26, as respectively shown in FIGS. 2&3.

Figure 4:
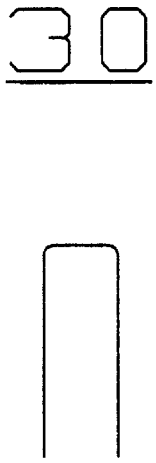
FIG. 4 is a front view showing a ⅝" staple.

This configuration of beams A–H 12,14,16,18,20,22,24,26 is permanently joined together by eight staple joints 28 located in the areas of beam overlap, as shown in FIG.1. Each staple joint 28 is produced using a staple gun (not shown) by shooting one ⅝" staple 30 (of dimensions 0.050"×0.035" with 7/32" crown), shown in FIG. 4, directly into the faces of three overlapping beams. Each staple joint 28 is centered approximately 0.6" from one end of a horizontal beam, as seen in FIG. 1, at a location where one horizontal beam is sandwiched by two vertical beams. For the staple joint 28 near the right end of beam A 12, a ⅝" staple 30 enters the face of vertical beam G 24, passes through the thickness of beam G 24, enters beam A 12, passes through the thickness of beam A 12, and enters beam H 26. In this manner the eight staple joints 28 function to interconnect the four horizontal beams 12,14,16,18 A,B,C,D to the four vertical beams E,F,G,H 20,22,24,26.

Figure 5:
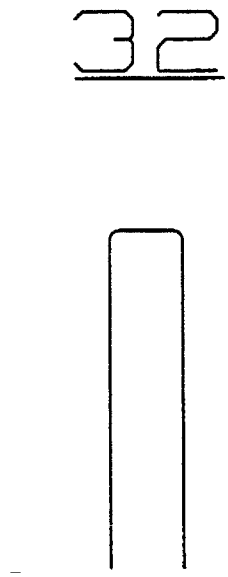
FIG. 5 is a front view showing a 1" staple.
Figure 6:
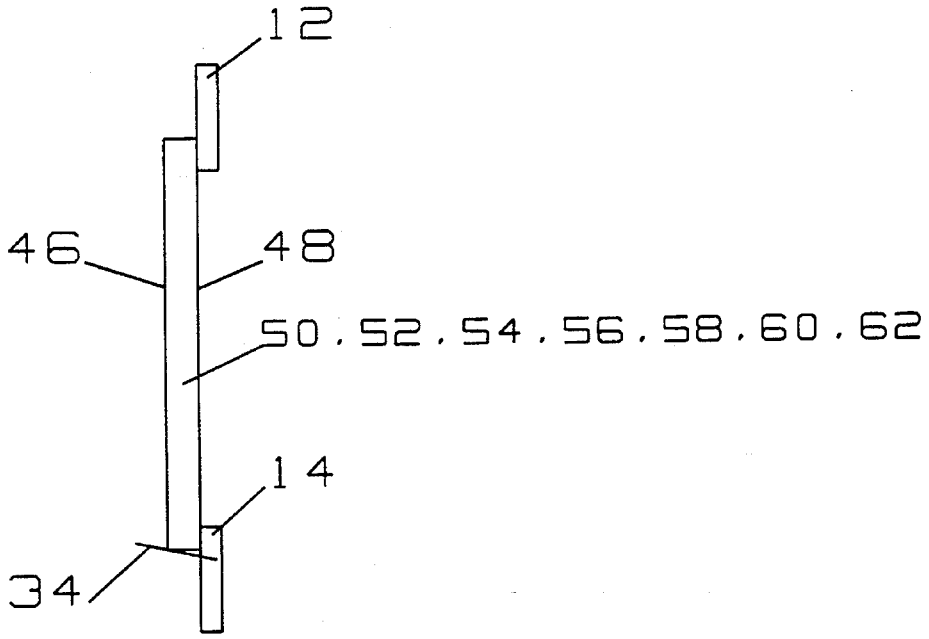
FIG. 6 is a fragmentary right side view of a CDJB in its display position.
Figure 7:
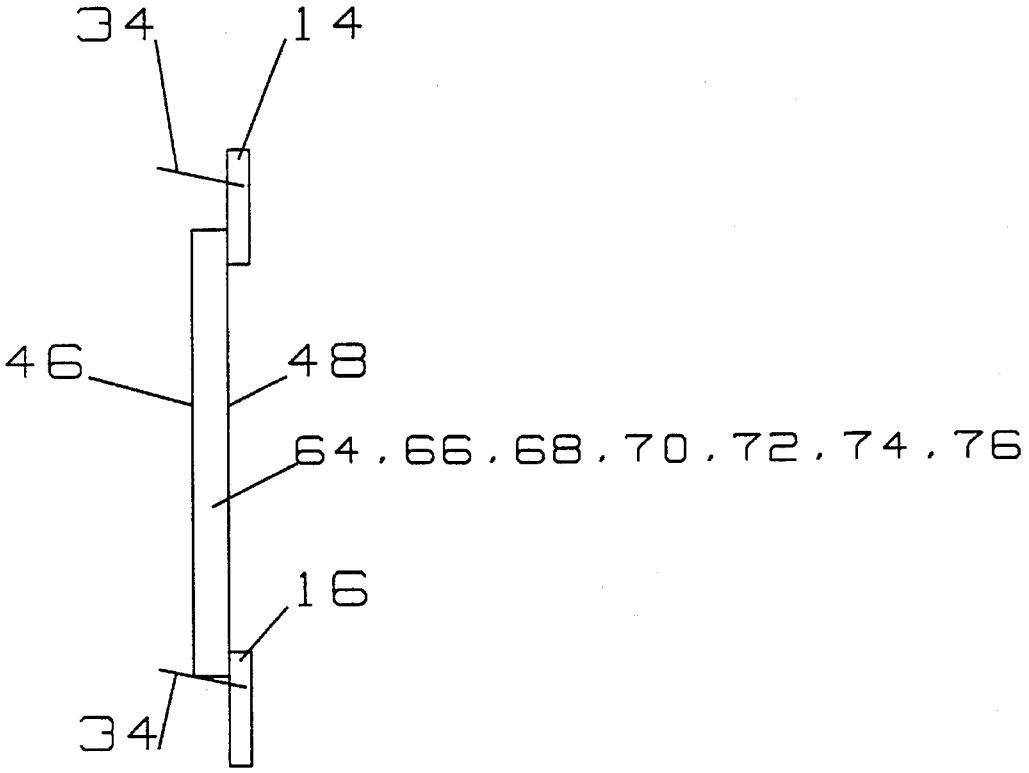
FIG. 7 is a fragmentary right side view of another CDJB in its display position.
Figure 8:
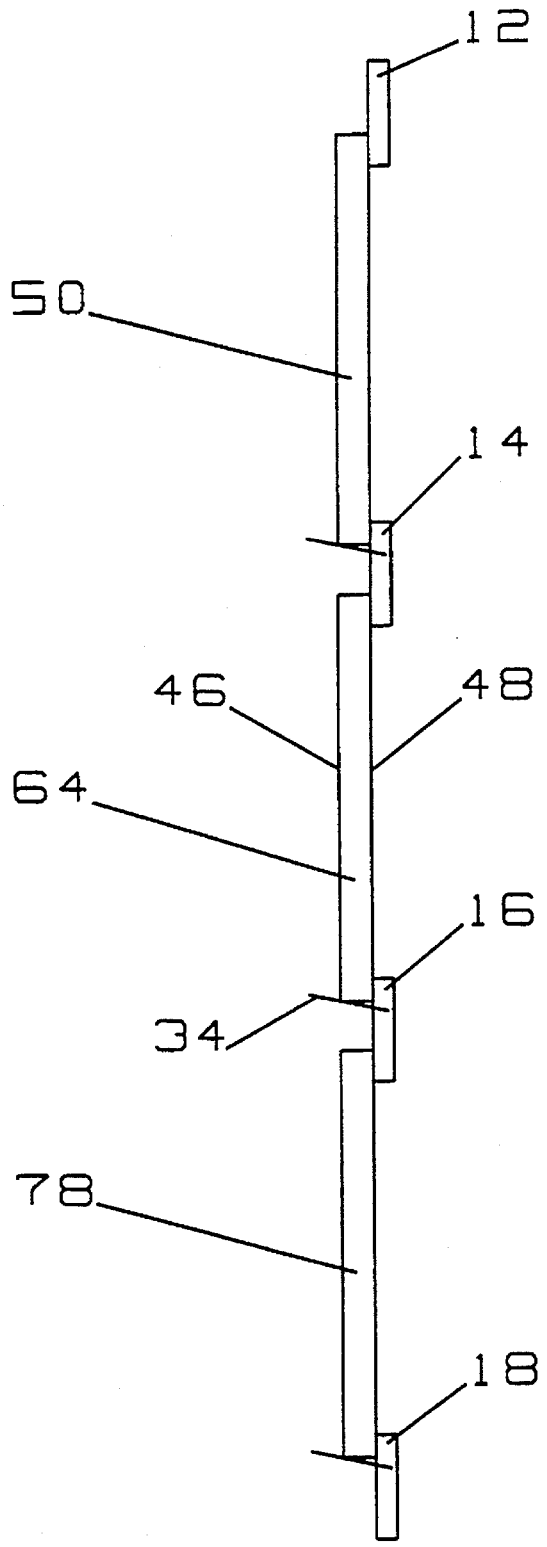
FIG. 8 is a fragmentary right side view showing three CDJB's in their display positions.

Horizontal beams B,C,D 14,16,18 each contain fourteen 1" staple protrusions 34, as shown in FIG. 1. For each of the beams B,C,D 14,16,18, the fourteen protrusions 34 are spaced in seven two-inch wide pairs, and each pair is separated by 3.85" from the pair immediately to its right or left. Each staple protrusion 34 is composed of a 1" long staple 32 (of dimensions 0.050"×0.035" with 7/32" crown), as shown in FIG. 5, hammered 3/16" deep into the beam's face. Importantly, the remaining 13/16" of the 1" staple 32 protrudes from the beam at a 12-degree upward, inclining angle, as shown in FIGS. 6, 7&8. To produce these staple protrusions 34 accurately and repetitively, a holding fixture (not shown) holds each 1" staple 32 in position for the hammering process, ensuring the proper hammering angle and depth.

Functioning as staple protrusions 34, 1" staples 32 provide both safety and function. Once hammered into the face of a beam, as shown in FIGS. 1, 6&7, the staple protrusions 34 have no sharp edges protruding from the beam. Staples 32 are therefore much less likely to cause human injury and are safer than simpler fasteners such as nails. Due to their 2-pronged design, as seen in FIG. 5, each 1" staple 32 enters the beam face at two locations during the hammering process. This improves stability over single-pronged fasteners. As a result, the staple protrusions 34 have less chance of loosening in the event of an external side impact than if composed of single-pronged fasteners.

Measuring from the left end of each of the 43.0 inch long horizontal beams B,C,D 14,16,18, the 1" staple protrusions 34 are centered at the following length locations, as depicted in FIG. 1: 3.0", 5.0", 8.85", 10.85", 14.7", 16.7", 20.55", 22.55", 26.4", 28.4", 32.25", 34.25", 38.1", and 40.1". Further, all 1" staple protrusions 34 are positioned 0.4" below the top edge of their respective beams B,C,D 14,16,18, as seen in FIGS. 6, 7&8. With the forty-two staple protrusions 34 in place, the CD wall frame 10 is now fully assembled.

Figure 9:
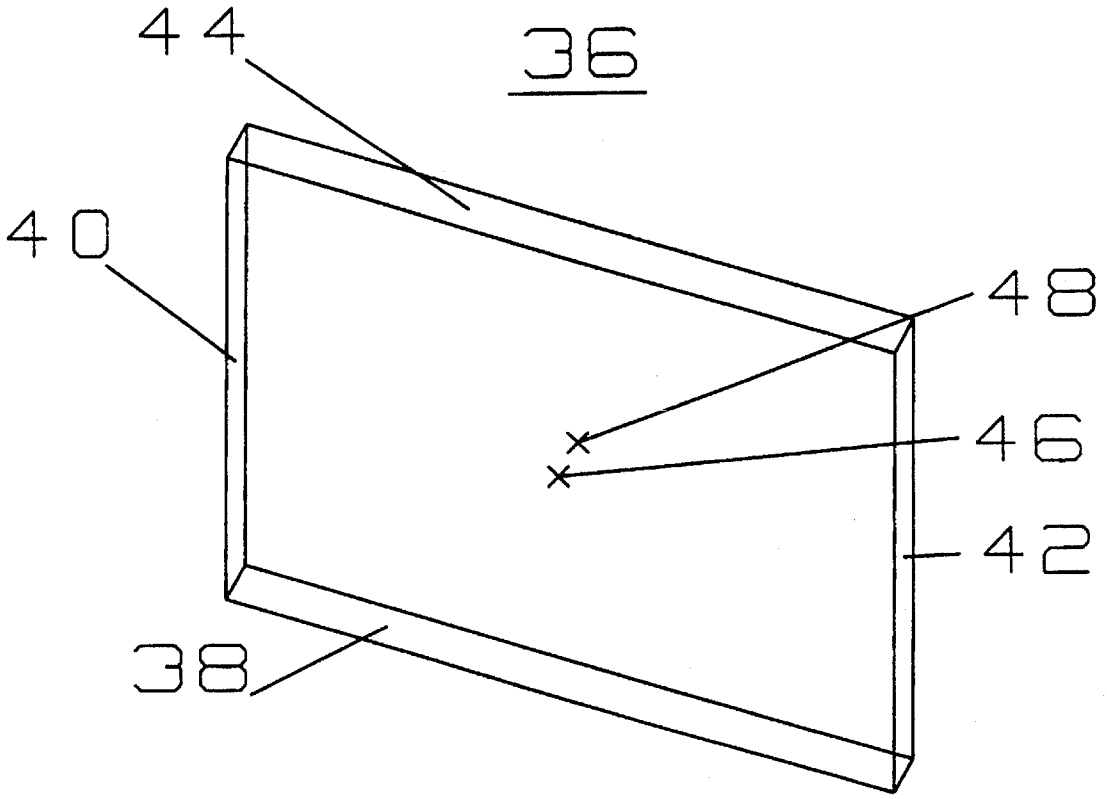
FIG. 9 is a isometric view of a CDJB.

To discuss the functional aspects of the CD wall frame 10, the nomenclature of a compact disc jewel box (CDJB) must be defined. FIG. 9 shows the exterior configuration of a CDJB 36. Each CDJB 36 is of approximate dimensions 5.6" L×4.9" W×0.4" T with a front face 46 that is hinged near the left title edge 40 and swings open at the right opening edge 42. Each CDJB 36 also includes a base edge 38, a top edge 44, and a back face 48.

Figure 10:
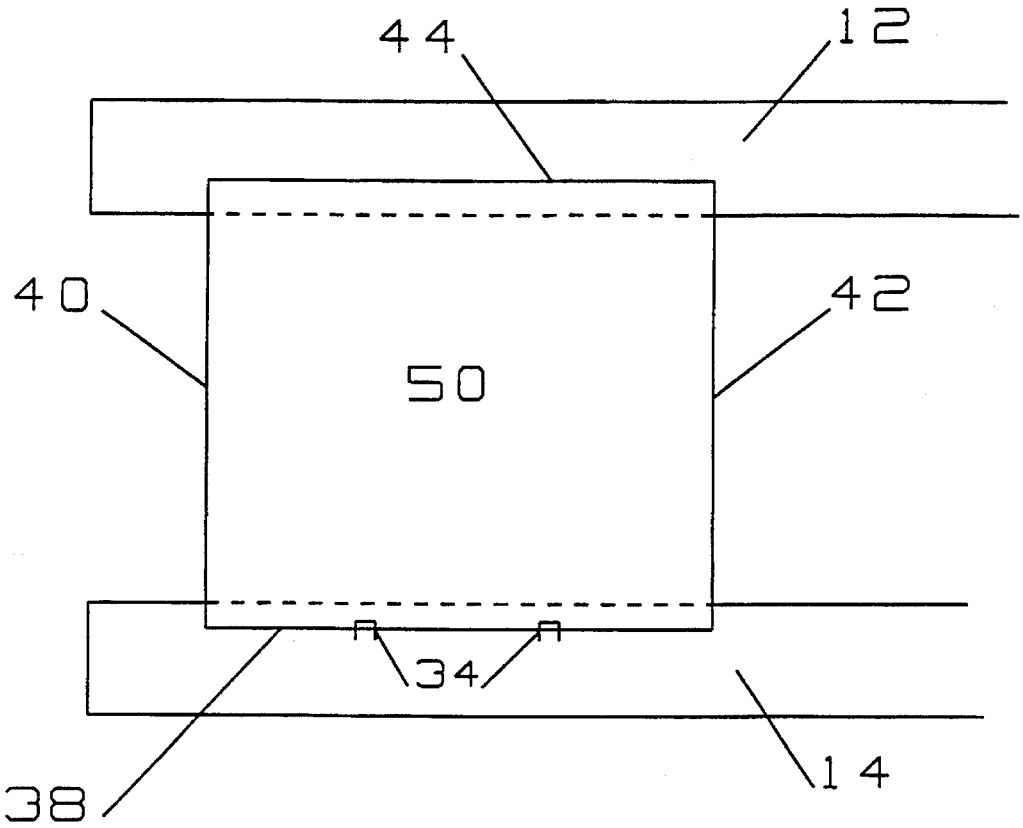
FIG. 10 is a front view showing a CDJB standing upright on a vertically hanging CD wall frame.
Figure 11:
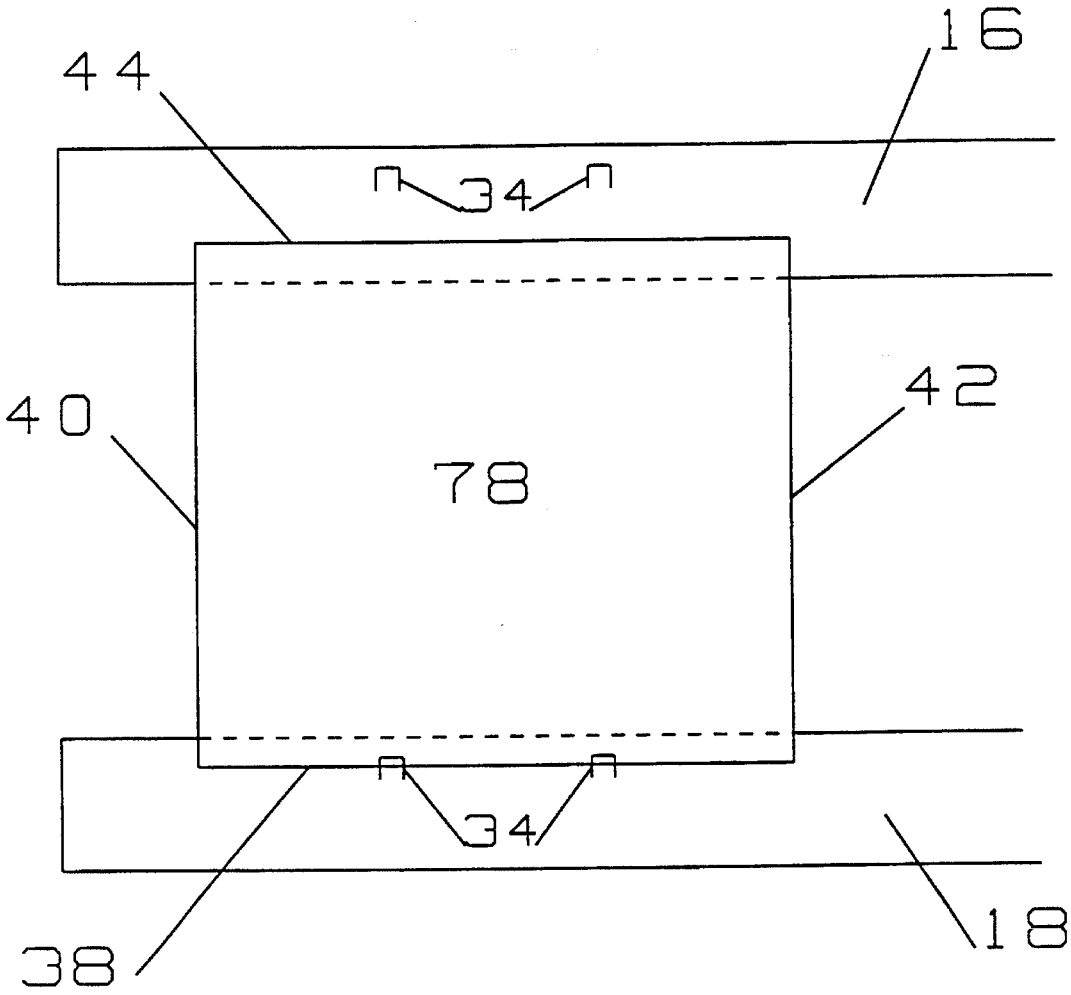
FIG. 11 is a front view showing another CDJB standing upright on a vertically hanging CD wall frame.
Figure 12:
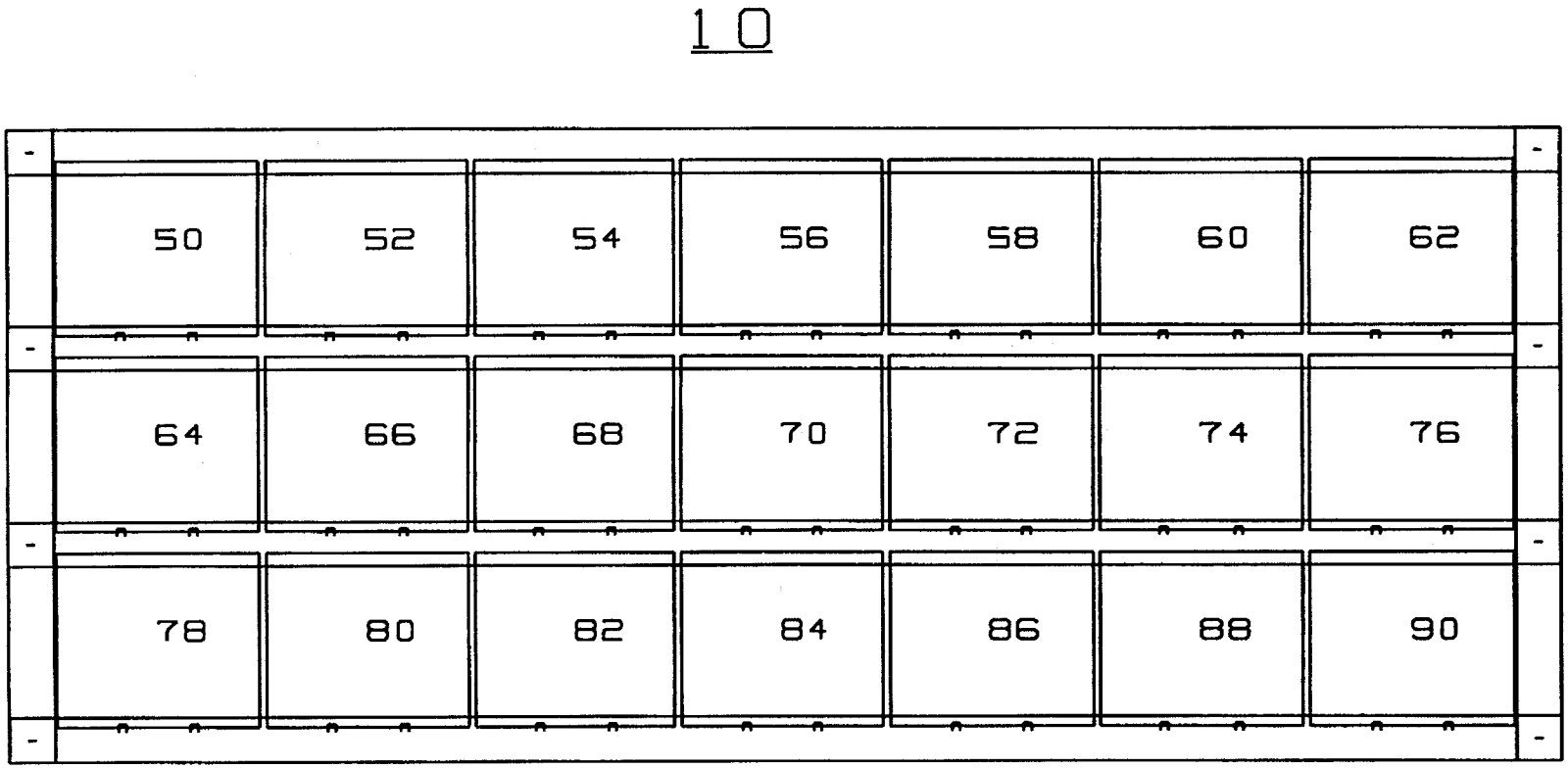
FIG. 12 is a front view showing a CD wall frame with twenty-one CDJB's in their display positions.

Using any suitable fastening means, the assembled CD wall frame 10 is hung vertically in its functional position, flush against a wall. Assuming the CD wall frame 10 is functionally positioned, the twenty-one CDJB's 36 are now loaded into their display positions. First, CDJB#1 50 is placed generally vertically by its owner so that it is standing on its base edge 38 generally centered over the first pair of protrusions 34 nearest the left end of beam B 14, as shown in FIGS. 10&12. CDJB#1 50 makes contact with the protrusions 34, and the protrusions 34 provide support to the base edge 38 of CDJB#1 50. Due to the 12-degree incline of the protrusions 34 plus the beneficial effects of gravity, CDJB#1 50 will lean backward toward horizontal beams A,B 12,14 when released from the grasp of its owner. Using his fingertips, the owner then pushes forward on the CDJB front face 46 of CDJB#1 50 until CDJB#1 50 rests flush against beams A,B 12,14, as seen in FIGS. 6&8. Beams A,B 12,14 contact and support the back face 48 of CDJB#1 50, stabilizing CDJB#1 50 in its display position. In its display position, CDJB#1 50 rests on the first pair of protrusions 34 on beam B 14, flush against beams A,B 12,14.

CDJB#2 52 is next generally centered over the second pair of protrusions 34 just to the right of CDJB#1 50. The owner then pushes CDJB#2 52 flush against beams A,B 12,14. This process is repeated for CDJB#3 through CDJB#7 54,56,58,60,62. CDJB#1 through CDJB#7 50,52, 54,56,58,60,62 are now located in their display positions, where they remain until removed or repositioned by their owner.

The fundamentals of this loading process are repeated for CDJB#8 through CDJB#21 64–90 until all of CDJB#1 50 through CDJB#21 90 are located in their display positions, as shown in FIG. 12. The 12-degree inclining angle of the protrusions combined with the effects of gravity discourage the CDJB's from falling forward off the CD wall frame 10 even in the presence of external forces. Incidental bumps or knocks to the CD wall frame 10 are insufficient to force CDJB's from their display positions.

In alternate embodiments (not shown), the physical dimensions of the CD wall frame 10, the number of staple joints 28, and the number of staple protrusions 34 may be altered to accommodate the desired number of rows and columns of CDJB's 36.

Although preferred embodiments of the invention have been described in the foregoing Detailed Description and illustrated in the accompanying Drawings, it will be understood that the invention is not limited to the embodiments disclosed, but is capable of numerous rearrangements, modifications and substitutions of parts and elements without departing from the spirit of the invention. Accordingly, the present invention is intended to encompass such rearrangements, modifications and substitutions of parts and elements as fall within the spirit and scope of the appended claims.

What is claimed is:

1. A compact disc (CD) wall frame for the storage and display of compact disc jewel boxes (CDJB's) comprising:

generally horizontal beams;

generally vertical beams overlapping said horizontal beams;

staple joints disposed in the overlap areas of said horizontal and vertical beams;

staple protrusions disposed on said horizontal beams for supporting CDJB's standing on edge;

fastening means for hanging said CD wall frame on a wall.

2. The CD wall frame of claim 1, wherein said staple protrusions protrude from said horizontal beams at an inclining angle.

3. The CD wall frame of claim 1, wherein said horizontal beams contact and support the back faces of said CDJB's located in their display positions on said CD wall frame.

* * * * *